US008166596B2

(12) United States Patent
Kang et al.

(10) Patent No.: US 8,166,596 B2
(45) Date of Patent: May 1, 2012

(54) CONSTRUCTION METHOD FOR GIRDER IN BRIDGE, CRANE FOR PULLING UP GIRDER, VEHICLE FOR CARRING GIRDER, AND GIRDER USED FOR THE SAME

(75) Inventors: Dong-Ok Kang, Kwacheon (KR); Man-Geun Yoon, Sungnam (KR); Hyun-Yang Shin, Seoul (KR); Yeong-Seon Kim, Dubai (AE)

(73) Assignee: Samsung Corporation (KR)

( * ) Notice: Subject to any disclaimer, the term of this patent is extended or adjusted under 35 U.S.C. 154(b) by 464 days.

(21) Appl. No.: 12/133,974

(22) Filed: Jun. 5, 2008

(65) Prior Publication Data

US 2008/0301889 A1 Dec. 11, 2008

(30) Foreign Application Priority Data

Jun. 5, 2007 (KR) ..... 10-2007-0054964

(51) Int. Cl.
*E01D 21/00* (2006.01)

(52) U.S. Cl. ..... 14/77.1

(58) Field of Classification Search ..... 14/77.1, 14/77.3, 23; 212/312, 324
See application file for complete search history.

(56) References Cited

U.S. PATENT DOCUMENTS

| | | | | | |
|---|---|---|---|---|---|
| 3,003,219 | A | * | 10/1961 | Suter et al. | 264/33 |
| 3,902,212 | A | * | 9/1975 | Muller | 14/77.1 |
| 4,282,978 | A | * | 8/1981 | Zambon | 212/312 |
| 4,497,153 | A | * | 2/1985 | Muller | 14/77.1 |
| 4,646,379 | A | * | 3/1987 | Muller | 14/23 |
| 5,173,981 | A | * | 12/1992 | Hasselkvist | 14/2.4 |
| 5,511,268 | A | * | 4/1996 | Albus et al. | 14/77.1 |
| 5,960,502 | A | * | 10/1999 | Sherman et al. | 14/77.1 |
| 7,210,183 | B2 | * | 5/2007 | Kornatsky | 14/77.1 |
| 7,401,371 | B2 | * | 7/2008 | Kornatsky | 14/77.1 |
| 7,520,014 | B2 | * | 4/2009 | Homsi | 14/77.1 |

FOREIGN PATENT DOCUMENTS

| | | |
|---|---|---|
| DE | 2251475 | 5/1974 |
| DE | 10-2004-002102 | 8/2005 |
| JP | 54-156326 | 12/1979 |
| JP | 2001-064915 | 3/2001 |
| JP | 2004-116205 | 4/2004 |
| JP | 2007-063797 | 3/2007 |

OTHER PUBLICATIONS

Japanese Office Action-Japanese Application No. 2008-148232 issued on Aug. 2, 2011, citing JP 2007-063797, JP 2004-116205, JP 2001-064915, JP 54-156326, DE 10-2004-0021002, US 5,511,268, and DE 2251475.

* cited by examiner

*Primary Examiner* — Thomas Will
*Assistant Examiner* — Abigail A Risic
(74) *Attorney, Agent, or Firm* — Cantor Colburn LLP

(57) ABSTRACT

A construction method for a girder in a bridge in which a plurality of piers are installed in an interval in a longitudinal direction of the bridge, a plurality of copings are installed on the piers, and a plurality of girders respectively installed between the piers are installed on the copings. The method comprises the steps of: installing at least one temporary girder on a front coping of the copings and a rear coping adjacent to the rear coping of the copings; installing a crane for pulling up a girder having a girder pulling up space therein guided by the temporary girder; and providing with a girder by a pre-cast method so as to install a girder on the front coping and the rear coping.

4 Claims, 9 Drawing Sheets

CONSTRUCTION METHOD FOR GIRDER IN BRIDGE, CRANE FOR PULLING UP GIRDER, VEHICLE FOR CARRING GIRDER, AND GIRDER USED FOR THE SAME

FIELD OF THE INVENTION

The present invention relates to a construction field, and more particularly, to a construction method for a girder in a bridge, a crane for pulling up a girder, a vehicle for carrying a girder, and a girder used for the same, capable of installing a girder on a pier for a bridge for building a bridge.

BACKGROUND OF THE INVENTION

In the conventional art, a construction structure is built by pouring concrete after installing a mold and reinforcements on the spot. However, the conventional method has a problem that the quality of the construction structure is greatly influenced by surrounding circumstances.

Accordingly, a pre-cast method is being actively supposed, by which members of a structure are provided in advance, and the members are an installed in the working place. The method has an advantage that the quality of the structure can be ensured regardless of the surrounding circumstances.

The method may have a problem that constructing equipment has to be additionally prepared near the working place, since each member of the structure has to be provided in advance. However, under the construction in a large scale, the construction duration and costs may be reduced by the method. Accordingly, the problem does not serve as a severe one.

In case of building a bridge, research is being actively performed, by which only piers are built according to an installation technique on the working place, and copings or girders manufactured in advance are installed.

For instance, according to a FSLM (Full Span Launching Method), all of girders for a bridge are provided in advance on a manufacturing line near the actual working place, and then sequentially undergo a temporary work at an upper side of piers, which is also referred to as a PSM (Pre-cast span method).

FIGS. 1 and 2 are schematic diagrams showing a basic concept of a construction method for a girder in a bridge according to the conventional art.

As shown in FIG. 1, a bridge is constructed by installing girders 30 on each upper surface of copings 20 installed above piers 10. As shown in FIG. 2, the girders 30 are sequentially moved to each section formed between the piers 10 and the copings 20 in a forward direction.

More concretely, the girder 30 is carried to a temporary work position by a vehicle 40 for carrying a girder, the vehicle moving on an upper surface of the installed girder 30. Then, the girder is pulled up by a crane thus to be installed at the temporary work position.

However, the conventional method has a disadvantage to be applied only to specific circumstances such as a railroad bridge, not to a general roadway bridge.

The railroad bridge has a characteristic that a secondary dead load (a load of a structure to be build on an upper surface of another bridge on a cobble road) or a live load (a load of a train) is much larger than a first dead load (a load of a bridge itself). With consideration of the specific characteristic, the railroad bridge is designed so that the piers 10 can have strength enough to resist large load exceeding the first dead load.

In order to minimize influence on structural stability, the girder 30 to be subsequently installed is carried through the installed piers 10, copings 20, and girder 30.

On the contrary, the general roadway bridge has a characteristic that the secondary dead load or the live load is smaller than the first dead load. Accordingly, the general roadway bridge is constructed so that each member can have strength enough to resist only the first dead load. As a result, a technique for building a railroad bridge need not to be applied to the general roadway bridge.

In order to apply a pre-cast method not by the building technique in the working place, to the roadway bridge, an additional means needs to be provided.

SUMMARY OF THE INVENTION

Therefore, an object of the present disclosure is to provide a construction method for a girder in a bridge capable of applying a pre-cast method even to a general roadway bridge, a crane for pulling up a girder, a temporary girder, a vehicle for carrying a girder, and a girder.

To achieve these and other advantages and in accordance with the purpose of the present disclosure, as embodied and broadly described herein, there is provided a construction method for a girder in a bridge which a plurality of piers are installed in an interval in a longitudinal direction of the bridge, a plurality of copings are installed on the piers, and a plurality of girders respectively installed between the piers are installed on the copings, the method comprising the steps of: installing at least one temporary girder on a front coping of the copings and a rear coping adjacent to the rear coping of the copings; installing a crane for pulling up a girder having a girder pulling up space therein guided by the temporary girder; manufacturing a girder by a pre-cast method so as to install a girder on the front coping and the rear coping; providing with a vehicle for carrying a girder, the vehicle being constituted so that load of a girder to the piers carried by the vehicle is distributed to the piers through the upper surface of the girders installed in advance; introducing the vehicle carrying a first girder moving along a guide of the temporary girder to a girder pulling up space of the crane; pulling up the first girder by the crane; drawing out the vehicle backward from the girder pulling up space; moving a first temporary girder of the temporary girders from a position where the first girder is to be installed to a front of the front coping of the one of the copings and installing the first temporary girder on a next front coping installed in a next front of the front coping and the front coping; and settling the first girder on the front coping and the rear coping by the crane.

The construction method for a girder in a bridge further comprises: the steps of introducing a vehicle moving by being guided by the temporary girder and the first girder and moving a second girder of the girders which is secondly installed for carrying a second girder to a girder pulling up space of the crane; pulling up the second girder by the crane; drawing out the vehicle backward from the girder pulling up space; moving a second temporary girder of the temporary girders from a position where the second girder is to be installed to a front of the front coping of the one of the copings and installing the second temporary girder on a next front coping installed in a next front of the front coping and the front coping; and settling the second girder on the front coping and the rear coping by the crane.

The construction method for a girder in a bridge further comprises a step of moving the crane guided by a guide of the first and the second temporary girders, after the step of settling the second girder.

Preferably, each of the piers may be provided with in an interval in a width direction of the bridge.

To achieve these and other advantages and in accordance with the purpose of the present disclosure, as embodied and broadly described herein, there is also provided a crane for the construction method, comprises a crane body and a plurality of supporters vertically installed at a lower side of the crane body, the supporters supporting the crane body, wherein the supporters comprise: a front left supporter and a front right supporter installed at the front coping; and a rear left supporter and a rear right supporter installed at the girder installed in advance.

The crane for pulling up a girder further comprises an up-down girder pulling device installed at the crane body, the up-down girder pulling device having a girder temporary mounting unit for pulling up a girder, in order to pull up or be settled to an upper side of a girder; and a right-left girder moving device for moving the up-down girder pulling device in right and left directions.

The crane for pulling up a girder further comprises a supplementary supporter installed at the lower side of the crane body so as to be opened and closed in up and down directions, and operated such that a lower end thereof is installed at the coping or the girder installed in advance when being closed, for resisting a load of the pulled-up girder together with the plurality of supporters when the girder is pulled up by the up-down girder pulling device.

Preferably, a crane base portion supported by being contacted with an upper surface of the coping or the girder installed in advance and a crane interval adjusting unit for adjusting an interval between the lower end of the supplementary supporter and the crane base portion may be provided with at the end of the supplementary supporter.

Preferably, the supplementary supporter is installed between the rear left supporter and the rear right supporter.

The crane for pulling up a girder further comprises: an up-down temporary girder pulling device installed at the crane body, the up-down temporary girder pulling device having a temporary girder temporary mounting unit for pulling up a temporary girder in order to pull up or be settled to an upper side of a temporary girder; and a back-forth temporary girder moving device for moving the up-down temporary girder pulling device in back and forth directions.

The crane for pulling up a girder further comprising a right-left temporary girder moving device for moving the up-down temporary girder pulling device in right and left directions.

The crane for pulling up a girder further comprises a temporary girder supporting portion vertically installed at a lower side of the crane body; and a temporary girder mounting and driving unit installed at a lower end of the temporary girder supporting portion and mounted at the temporary girder, for allowing a relative operation between the temporary girder and the lower end of the temporary girder supporting portion.

Preferably, the temporary girder mounting and driving portion may include a temporary girder mounting portion extended by being divided into two parts from the lower end of the temporary girder supporting portion; and a side guide roller portion installed at a lower end of the temporary girder mounting portion, and moving along side guide grooves formed at both sides of the temporary girder.

Preferably, the crane body may include a crane extended body portion extending towards a front of the front coping, and the temporary girder supporting portion and the temporary girder mounting and driving unit are respectively installed at sides of the front left supporter and the front right supporter, and at a front lower side of the crane extended body portion, respectively.

A pair of the temporary girder supporting portions are installed at right and left sides of the front left supporter, and a pair of the temporary girder mounting and driving units are installed at right and left sides of the front right supporter.

To achieve these and other advantages and in accordance with the purpose of the present disclosure, as embodied and broadly described herein, there is still also provided a temporary girder used to the construction method, comprises side guide grooves formed at both sides for guiding the crane.

According to a second aspect, there is provided a temporary girder used to the construction method, wherein the temporary girder is installed at right and left sides of the front left supporter in one pair, and is installed at right and left sides of the front right supporter in one pair.

According to a third aspect, there is provided a temporary girder used to the construction method, comprising: a temporary girder base portion installed at a lower side thereof, and supported by contacting an upper surface of the coping; and a temporary girder interval adjusting portion for adjusting an interval between a lower surface of the temporary girder and the temporary girder base portion.

According to a fourth aspect, there is provided a temporary girder used to the construction method comprising: a temporary girder moving base portion installed on a lower surface of the temporary girder so as to be movable back and forth, and installed on an upper surface of the front coping or the next front coping, for preventing downward deformation of the temporary girder being moved towards a front side of the front coping; and a moving base portion driving device for applying a driving force to the temporary girder moving base portion in back and forth directions.

According to a fifth aspect, there is provided a temporary girder used to the construction method comprising: a temporary girder moving base portion installed on a lower surface of the temporary girder so as to be movable back and forth, and installed on an upper surface of the front coping or the next front coping, for preventing downward deformation of the temporary girder being moved towards a front side of the front coping; a moving base portion driving device for applying a driving force to the temporary girder moving base portion in back and forth directions; and a moving base portion temporary coupling device for temporarily coupling the moving base portion to the temporary girder when the temporary girder is forward moved by the crane for pulling up a girder.

To achieve these and other advantages and in accordance with the purpose of the present disclosure, as embodied and broadly described herein, there is yet still also provided a vehicle for carrying a girder, used to the construction method comprising: a left wheel operated by a guide of the first temporary girder or the first girder; a right wheel operated by a guide of the second temporary girder or the second girder; and a central body portion having a supporting portion for the girder at a central part thereof, for connecting the left and the right wheels with each other.

According to a second aspect, there is provided a vehicle for carrying a girder, used to the construction method comprising: a left wheel operated by a guide of the first temporary girder or the first girder;

a right wheel operated by a guide of the second temporary girder or the second girder; and a central body portion having a supporting portion for the girder at a central part thereof, for connecting the left and right wheels with each other, wherein one pair of right and left head portions are formed at a front end of the left wheel by being divided into two so as to be driven via one pair of temporary girder mounting and driving portions installed at right and left sides of the front left supporter, wherein one pair of right and left head portions are formed at a front end of the right wheel by being divided into two so as to be driven via the one pair of temporary girder mounting and driving portions installed at right and left sides of the front right supporter.

Preferably, the vehicle for carrying a girder further comprises a wheel connecting portion installed at each front end of the one pair of head portions of the left wheel and the one pair of head portions of the right wheel, for connecting the respective one pair of head portions of the left and right wheels with each other; and wheel connecting portion opening/closing means for opening and closing the wheel connecting portion, so as to prevent interference between the wheel connecting portion and the temporary girder mounting and driving portion while the wheel is driven.

Preferably, the wheel connecting portion opening/closing means may include a hinge portion installed at one end of the wheel connecting portion; and a wheel connecting portion opening/closing device mounted at the hinge portion, for opening and closing another end of the wheel connecting portion.

According to a third aspect, there is provided a vehicle for carrying a girder, used to the construction method comprising: a left wheel operated by a guide of the first temporary girder or the first girder; a right wheel operated by a guide of the second temporary girder or the second girder; and a central body portion having a supporting portion for the girder at a central part thereof, for connecting the left and right wheels with each other, wherein the supporting portion of the girder comprises: one pair of wing portions for upward supporting the girder; and a wing portion opening/closing device for inward closing the one pair of wing portions, so as to prevent interference between the one pair of wing portions and the supplementary supporter, at the time when the vehicle for carrying a girder is backward moved after the supplementary supporter is closed.

To achieve these and other advantages and in accordance with the purpose of the present disclosure, as embodied and broadly described herein, there is another yet still also provided a girder used to the construction method comprising: a guide groove formed on an upper surface of the girder, for guiding a lower end of the rear left supporter or the rear right supporter of the crane for pulling up a girder, by a guide of the first and the second temporary girders installed at upper sides of the second front coping and the front coping, at the time when the crane for pulling up a girder is moved to be installed at upper sides of the next front coping and the front coping.

BRIEF DESCRIPTION OF THE DRAWINGS

FIG. 1 is a side view; and

FIG. 2 is a perspective view;

FIG. 3 is a perspective view showing a step of installing a temporary girder;

FIG. 4 is a perspective view showing a step of installing a crane for pulling up a girder;

FIG. 5 is a perspective view showing a step of introducing a vehicle for carrying a first girder;

FIG. 6 is a perspective view showing a step of pulling up a first girder;

FIG. 7 is a perspective view showing a step of moving a temporary girder;

FIG. 8 is a perspective view showing a step of settling a first girder;

FIG. 9 is a perspective view showing a step of settling a second girder;

FIG. 10 is a perspective view showing a step of moving a crane for pulling up a girder.

DETAILED DESCRIPTION OF THE INVENTION

Hereinafter, a construction method for a girder in a bridge, a crane for pulling up a girder, a temporary girder, a vehicle for carriage a girder, and a girder used for the same will be explained in more detail with reference to the attached drawings.

FIGS. 3 to 10 are mimetic diagrams showing a construction method for a girder in a bridge according to the present invention.

As shown, in the present invention, a plurality of piers 10 are installed in an interval in a longitudinal direction of the bridge. A plurality of copings 20 are installed on the piers 10, and a plurality of girders 100 respectively installed between the piers are installed on the copings.

The construction method will be explained according to a construction order.

Figure 1:
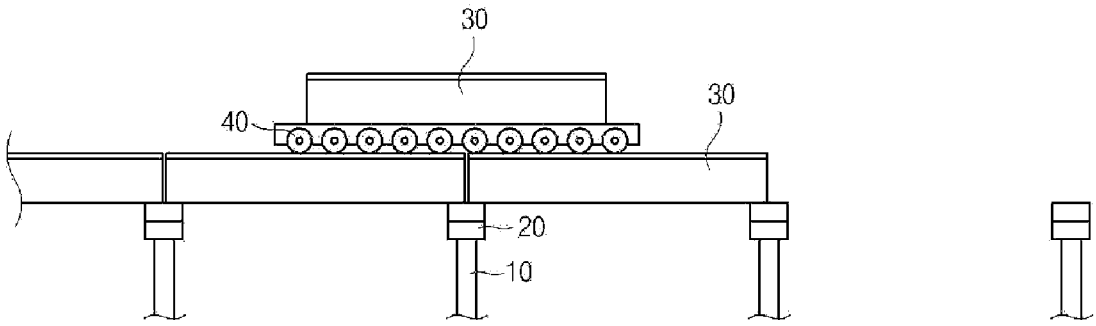
FIGS. 1 and 2 are schematic diagrams showing a construction method for a girder in a bridge according to the conventional art.
Figure 2:
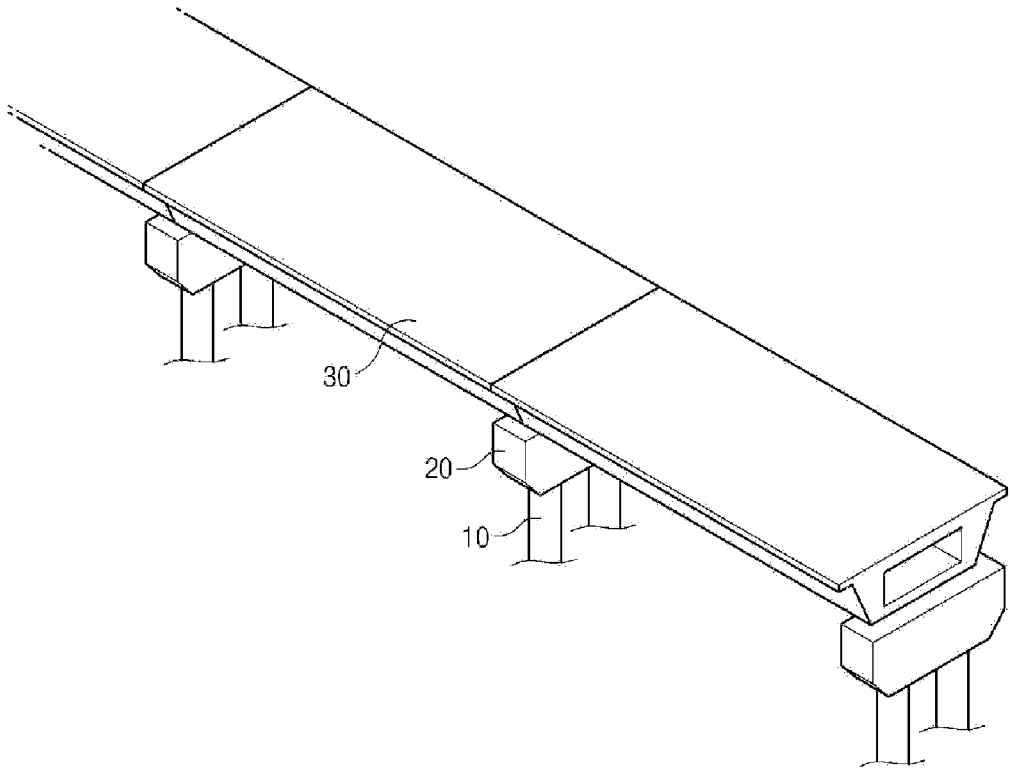
Figure 3:
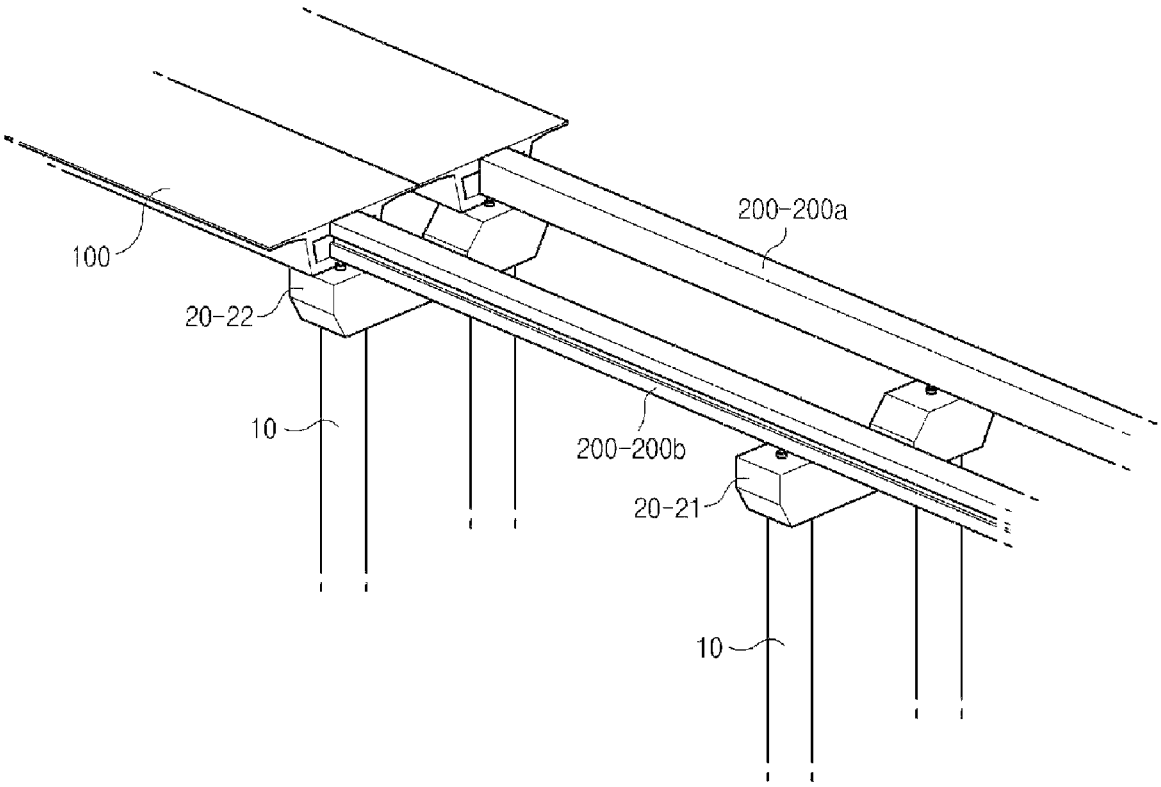
FIGS. 3 to 10 are mimetic diagrams showing a construction method for a girder in a bridge according to the present invention.

First, at least one temporary girder 200 on the front coping 21 of the copings 20 and the rear coping 22 of the copings 20 where the plurality of girders 100 are to be settled (a step of installing at least one temporary girder shown in FIG. 3).

Figure 4:
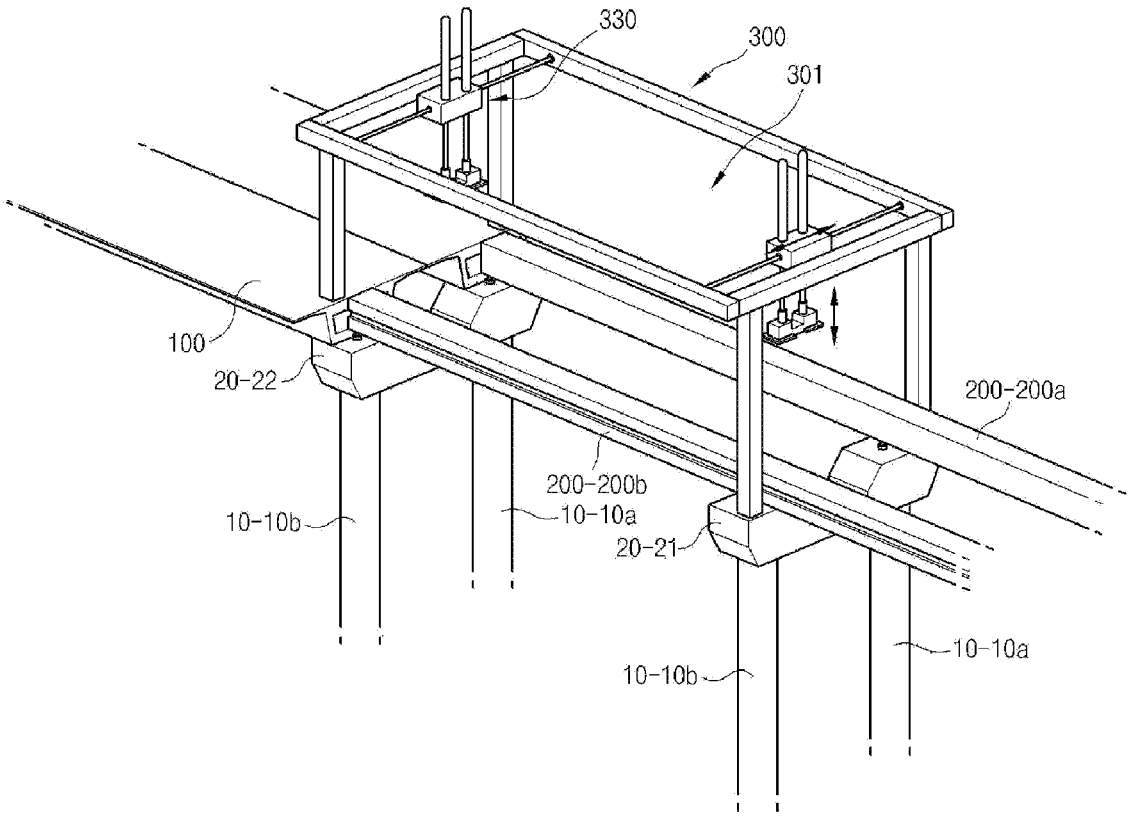
Figure 5:
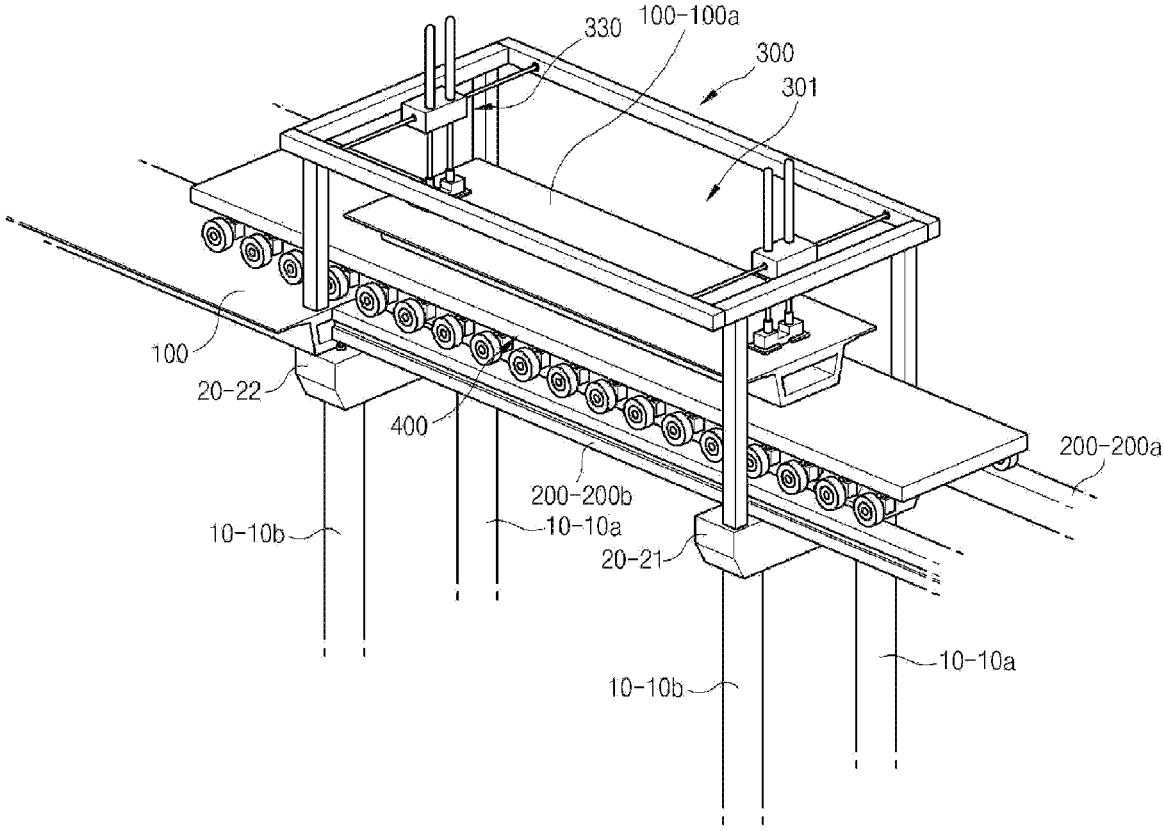

Next, by a guide of the temporary girder 200, a crane 300 for pulling up a girder having a girder pulling up space 301 therein is installed on the front coping 21 and a girder 100 installed in advance (a step of installing a crane for pulling up a girder shown in FIG. 4).

Next, a girder 100 is manufactured or provided with by a pre-cast method in order to install a girder 100 on the front coping 21 and the rear coping 22 (a step of providing with a girder).

Next, a vehicle 400 for carrying a girder is provided. The vehicle 400 is being constituted so that load of a girder 100 to the piers 10 carried by the vehicle 400 is distributed to the piers 10 through the upper surface of the girders 100 installed in advance (a step of providing a vehicle for carrying a girder).

Next, the vehicle is introduced for carrying a first girder 100*a* to the girder pulling space 301 of the crane 300, by moving along the guide of the temporary girder 200. (a step of introducing a vehicle for carrying a first girder shown in FIG. 5)

Figure 6:
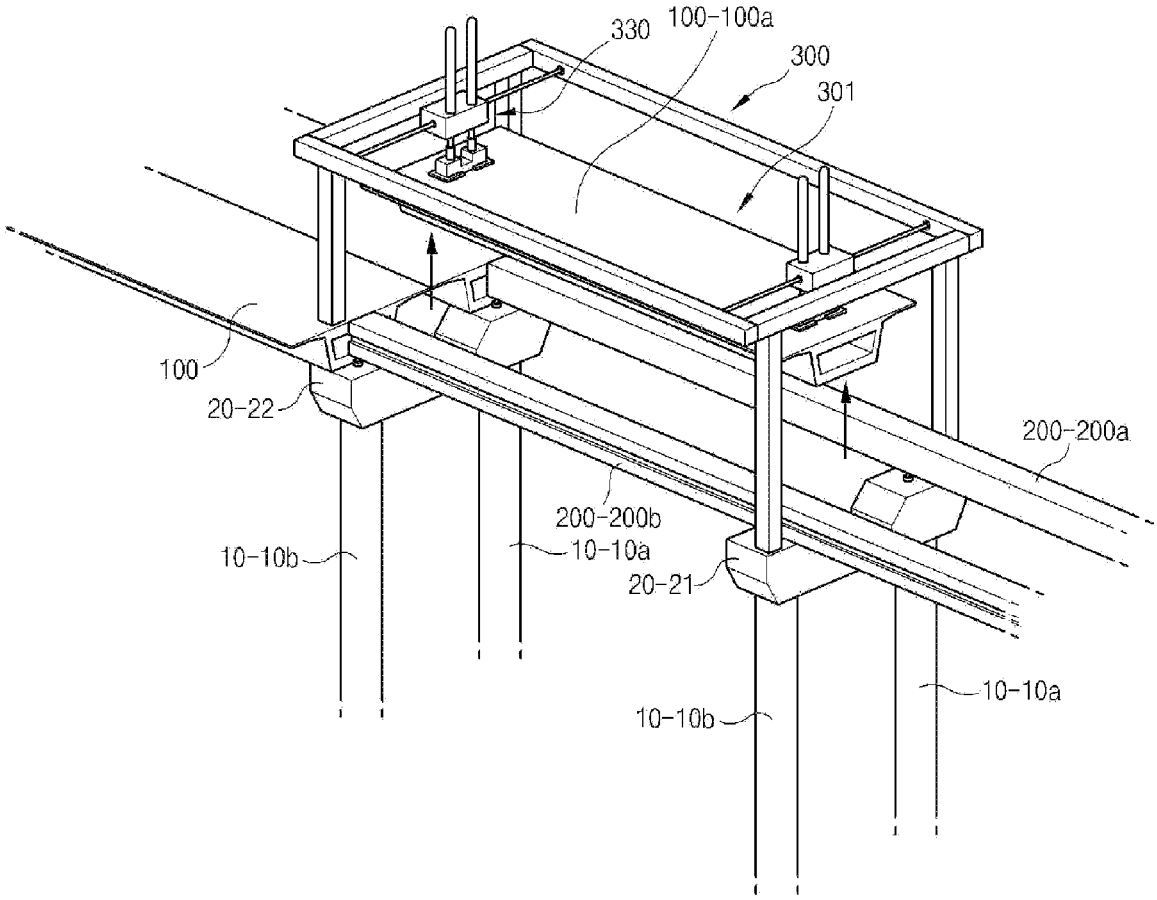

Next, the first girder 100*a* is upwardly pulled by the crane 300 (a step of pulling up a first girder shown in FIG. 6).

Next, the vehicle 400 is backward drawn out of the girder pulling space 301 (a step of drawing out the vehicle for carrying a first girder shown in FIG. 6).

Figure 7:
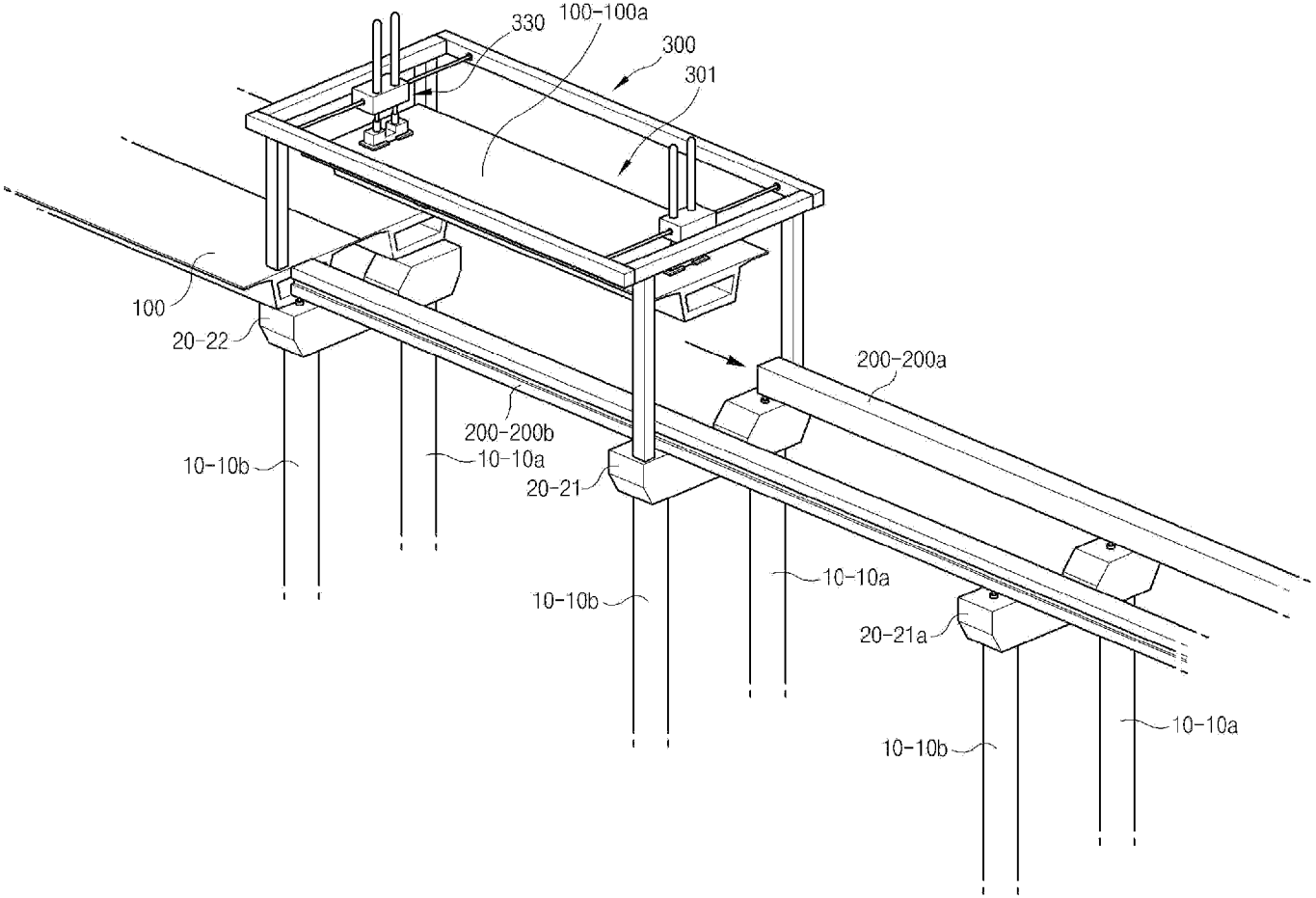

Next, a first temporary girder 200*a* of the temporary girders 200 is moved from a position where the first girder 100*a* is to be installed to a front of the front coping 21, and the first temporary girder 200*a* on a next front coping 21*a* installed in a next front of the front coping 21 and the front coping 21 is installed (a step of moving a first temporary girder shown in FIG. 7).

Figure 8:
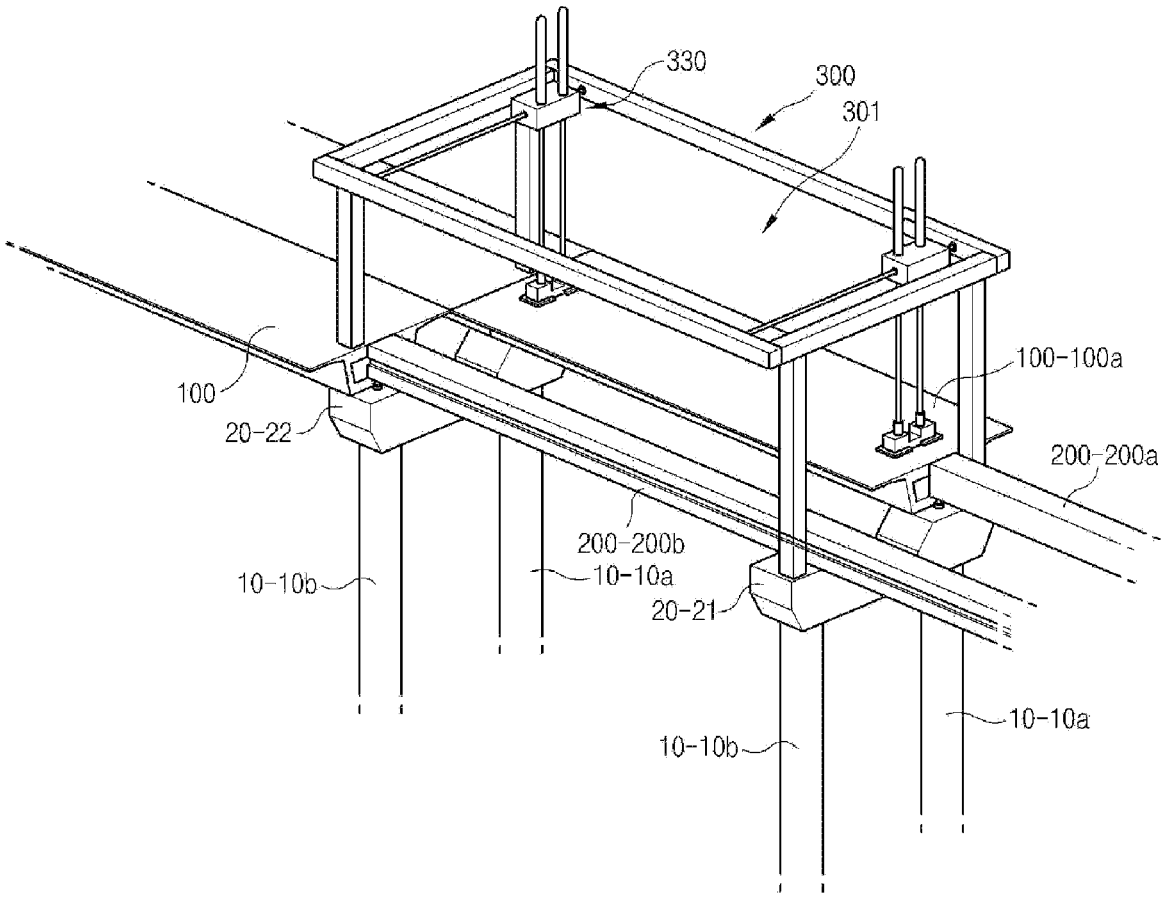

Next, the first girder 100*a* is settled on the front coping 21 and the rear coping 22 by the crane 300 (a step of settling the first girder shown in FIG. 8).

As the above steps are repeated, a next girder is settled next the first girder, and the same steps are performed in a longitudinal direction of the bridge, thereby obtaining a bridge.

The construction method according to the present invention is differentiated from the conventional method by the following two aspects.

First, when the girders 100 are settled on the copings 20, one girder of the girders is settled in one time of the above steps.

More concretely, in case of a general roadway bridge, a plurality of girders are settled between piers and one of the plurality of girders is settled in one time of the steps, in order to overcome the conventional problem that the girder 100, the pier 10 and the copings are not installed with a high strength differently from a railroad bridge.

Second, in a process for carrying the girder 100 to be settled through an upper surface of the girder 100 installed in advance and then pulling up the girder 100 by the crane 300, a new element, temporary girder is used so as to uniformly distribute loads of the girder 100 to be installed, the crane 300, and the vehicle 400 to at least two copings 20 and the piers 10 supporting the copings 20.

That is, since the vehicle 400 is supported by the girder 100 installed in advance and the temporary girder 200, during the vehicle 400 is moved, the loads are distributed to the copings 20 and the piers 10 installed at least two interval.

Furthermore, since the crane 300 is installed on the front coping 21 and the girder 100 installed in advance, the loads thereof is distributed to the two copings 20 and the piers 10.

In the present invention, an construction method by a precast having advantages such as a high quality, a shortened construction duration, and a reduced construction cost without influencing on structural stability can be applied to a general roadway bridge.

A process subsequent to the installation of the first girder 100*a* will be explained in more detail.

First, the vehicle 400 is introduced for carrying a second girder 100*b* to the girder pulling space 301 of the crane 300, by moving along the temporary girder 200 and the first girder 100*a* installed in advance. (a step of introducing a vehicle for carrying a second girder shown in FIG. 5)

Next, the second girder 100*b* is upwardly pulled by the crane 300 (a step of pulling up a second girder shown in FIG. 6).

Next, the vehicle 400 is backward drawn out of the girder pulling space 301 (a step of drawing out the vehicle for carrying a second girder shown in FIG. 6).

Next, a second temporary girder 200*b* of the temporary girders 200 installed where the second girder 100*b* is to be settled is moved to a front of the front coping 21, and the second girder 100*b* is installed on the next front coping 21*a* and the front coping 21 by the crane 300 (a step of mounting the second girder shown in FIG. 7).

Figure 9:
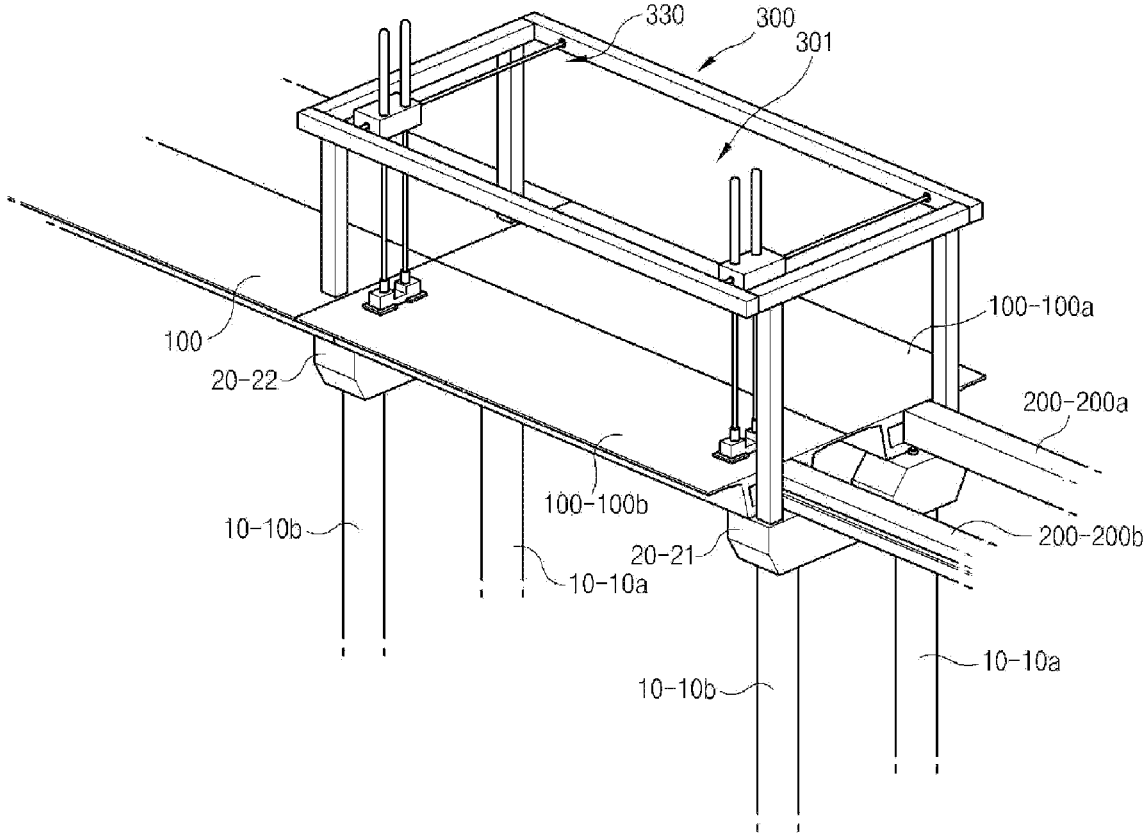

The second girder 100*b* is installed on the front coping 21 and the rear coping 22 (a step of installing the second girder shown in FIG. 9).

Figure 10:
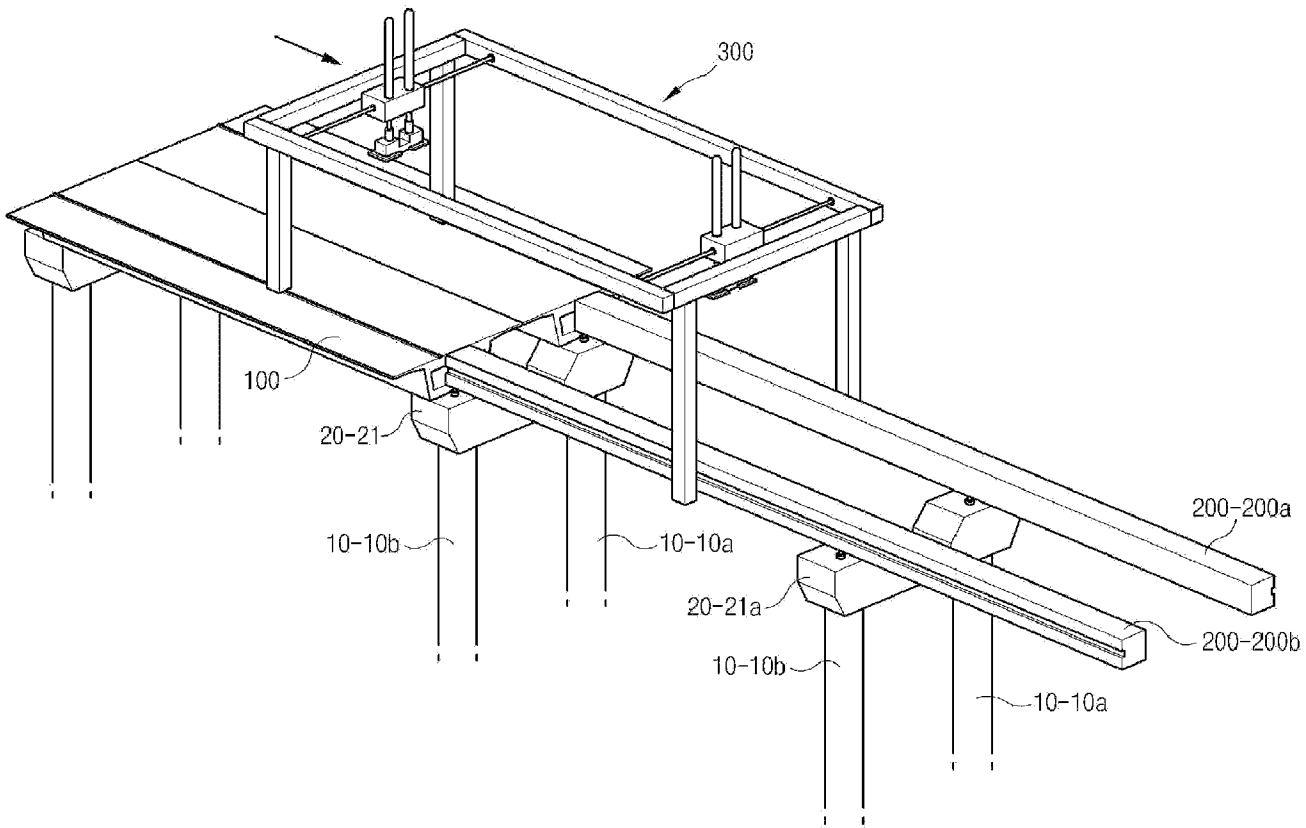

Next, the crane 300 is moved to a next position and installed on the next front coping 21*a* and the front coping 21, by being guided by the first temporary girders 200*a* and the second temporary girders (a step of moving a crane for pulling up a girder shown in FIG. 10).

As the above steps are repeated in a longitudinal direction of the bridge, a bridge having a desired length can be obtained.

While the crane 300 is moved, since a load of the crane 300 is uniformly distributed by the settled girder 100 and the temporary girder 200, structural stability for a bridge is not degraded at all.

The plurality of piers 10 preferably are provided with in an interval in a width direction of the bridge for structural stability. That is, the plurality of piers 10 includes a left pier 10*a* and a right pier 10*b* in a width direction of the bridge.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A construction method for a girder in a bridge in which a plurality of piers are installed in an interval in a longitudinal direction of the bridge, and a plurality of copings are installed on the piers, the method comprising the steps of:

installing at least one temporary girder between a first coping and a second coping adjacent to the first coping;

installing a crane between the first and second copings, the crane including a girder pulling up space therein;

moving a vehicle loaded with a girder into the girder pulling up space of the crane, the vehicle moving on and along the temporary girder;

pulling up the girder by the crane;

drawing out the vehicle backward from the girder pulling up space;

moving the temporary girder to between the second coping and a third coping adjacent to the second coping; and settling the girder onto the first and second copings, wherein the steps of drawing out the vehicle, moving the temporary girder and settling the girder are performed in the described order.

2. The construction method for a girder in a bridge of claim 1, further comprising the step of:

moving and installing the crane between the second and third copings, the crane being guided by the settled girded and the temporary girder, after the step of settling the girder.

3. A construction method for a girder in a bridge in which a plurality of piers are installed in an interval in a longitudinal direction of the bridge, and a plurality of copings are installed on the piers, the method comprising the steps of:

installing a pair of first and second temporary girders between a first coping and a second coping adjacent to the first coping;

installing a crane between the first and second copings, the crane including a girder pulling up space therein;

moving a vehicle loaded with a first girder into the girder pulling up space of the crane, the vehicle moving on and along the first and second temporary girders;

pulling up the first girder using the crane;

drawing out the vehicle backward from the girder pulling up space;

moving the first temporary girder to between the second coping and a third coping adjacent to the second coping;

settling the first girder onto the first and second copings using the crane, wherein the steps of drawing out the vehicle, moving the first temporary girder and settling the first girder are performed in the described order;

moving the vehicle loaded with a second girder into the girder pulling up space of the crane, the vehicle moving on and along the settled first girder and the second temporary girder;

pulling up the second girder using the crane;

drawing out the vehicle backward from the girder pulling up space;

moving the second temporary girder to between the second coping and the third coping; and settling the second girder onto the first and second copings, wherein the steps of drawing out the vehicle, moving the second temporary girder and settling the second girder are performed in the described order.

4. The construction method for a girder in a bridge of claim 3, further comprising the step of:

moving and installing the crane between the second and third copings, the crane being guided by the settled girders and the temporary girders, after the step of settling the girder.

* * * * *